US005709556A

United States Patent [19]

Tan et al.

[11] Patent Number: 5,709,556

[45] Date of Patent: Jan. 20, 1998

[54] CONNECTOR WITH AUXILIARY ALIGNMENT PLATE

[75] Inventors: Haw-Chan Tan, Diamond Bar, Calif.; Kun-Tsan Wu, Tu-Chen City, Taiwan

[73] Assignee: Hon Hai Precision Ind. Co., Ltd., Taiwan

[21] Appl. No.: 564,377

[22] Filed: Nov. 24, 1995

[51] Int. Cl.[6] ..... H01R 9/09

[52] U.S. Cl. ..... 439/79; 439/567; 439/751

[58] Field of Search ..... 439/79, 80, 607, 439/567, 570, 571, 572, 573, 557, 751

[56] References Cited

U.S. PATENT DOCUMENTS

| | | | |
|---|---|---|---|
| 5,104,326 | 4/1992 | Smith et al. | 439/607 |
| 5,178,557 | 1/1993 | Hashiguchi | 439/570 |
| 5,184,963 | 2/1993 | Ishikawa | 439/567 |
| 5,468,154 | 11/1995 | Yip et al. | 439/79 |
| 5,591,036 | 1/1997 | Doi et al. | 439/79 |

*Primary Examiner*—Neil Abrams
*Assistant Examiner*—Barry Matthew L. Standig

[57] ABSTRACT

An electrical connector (10) includes an insulative housing (12) defining a plurality of passageways (14) therein for receiving therein a plurality of corresponding contacts (40) wherein the tail (42) of each contact (40) extends downward into a corresponding hole disposed in a PC board (100) on which the connector (10) is mounted. Each contact (40) further includes a contact section (44) for engagement with a mating contact of a complementary connector, and a retention section (46) positioned between the contact section (44) and the tail (42) wherein such retention section (46) includes a pair of opposite compliance expansions (47) defining an opening (48) therebetween so that such pair of expansions (47) may abut against the internal walls of the passageway (14) in the housing (12) for retaining the contacts (40) in position in the housing (12). An auxiliary alignment plate (50) adapted to be attached to the rear portion of the housing (12), includes a plurality of through-holes (52) for allowing the corresponding number of contact tails (42) to extend therethrough for a preliminary alignment of the contact tail (42) with the corresponding holes in the PC board (100), and further includes two opposite posts (56) integrally extending downward on two opposite ends thereof, wherein each post (56) includes a pair of diametrical slits (60) along its axial direction so that a pair of spaced legs (30) of each boardlock (20) disposed on one end of the housing (12), may be aligned within the corresponding slits (60) in the post (56) to have a correct position with regard to the corresponding hole (102) in the PC board (100).

5 Claims, 5 Drawing Sheets

CONNECTOR WITH AUXILIARY ALIGNMENT PLATE

BACKGROUND OF THE INVENTION

1. Field of The Invention

The invention relates to I/O (Input/Output) connectors, and particularly to the connector having an auxiliary alignment plate for both aligning the contact tails and the boardlocks both of which extend downward on the rear portion of the connector for reception within the corresponding holes in the PC board on which such connector is mounted.

2. The Prior Art

High density I/O connectors are desired recently in the computer field for efficiently transferring a hugh amount of signals within a short period occurring between the computer and the corresponding periphery. At the same time, the dimension of the computer and its internal components are also asked to be reduced for compliance with the miniaturization trend. Based on these requirements, the conventional retention between the contacts and the connector, which generally uses barbs projecting from the contact and piercing into the housing of the connector, may jeopardize the tiny and fragile internal structure of the connector housing which defines the corresponding cavities to receive the corresponding contacts therein.

Additionally, because the contacts and the boardlocks become tinier and tinier, it is required to have an alignment device to align not only the downward contact tails of the contacts but also the legs of the boardlocks with regard to the corresponding contact holes and the boardlock holes in the PC board on which the connector is mounted.

Therefore, an object of the invention is to provide a contact having thereon a retention device which can efficiently retain the contact within the corresponding cavity but not damage the housing of the connector.

Another object of the invention is to provide an auxiliary plate for both aligning the tails of the contacts and the legs of the boardlocks, both of which extend downward into the corresponding holes disposed in the PC board on which the connector is mounted.

SUMMARY OF THE INVENTION

According to an aspect of the invention, an electrical connector includes an insulative housing defining a plurality of passageways therein for receiving a plurality of corresponding contacts therein wherein the tail of each contact extends downward into a corresponding hole disposed in a PC board on which the connector is mounted. Each contact further includes a contact section for engagement with a mating contact of a complementary connector, and a retention section positioned between the contact section and the tail wherein such retention section includes a pair of opposite compliance expansions defining an opening therebetween so that such pair of expansions may abut against the internal walls of the passageway in the housing for retaining the contacts in position in the housing. An auxiliary alignment plate adapted to be attached to the rear portion of the housing, includes a plurality of through holes for allowing the corresponding number of contact tails to extend therethrough for a preliminary alignment with the corresponding holes in the PC board, and further includes two opposite posts integrally extending downward on two opposite ends thereof, wherein each post includes a pair of diametrical slits along its axial direction so that a pair of spaced legs of each boardlock disposed on one end of the housing, may be aligned within the corresponding slits in the post to have a correct position with regard to the corresponding hole in the PC board.

DETAILED DESCRIPTION OF THE PREFERRED EMBODIMENT

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
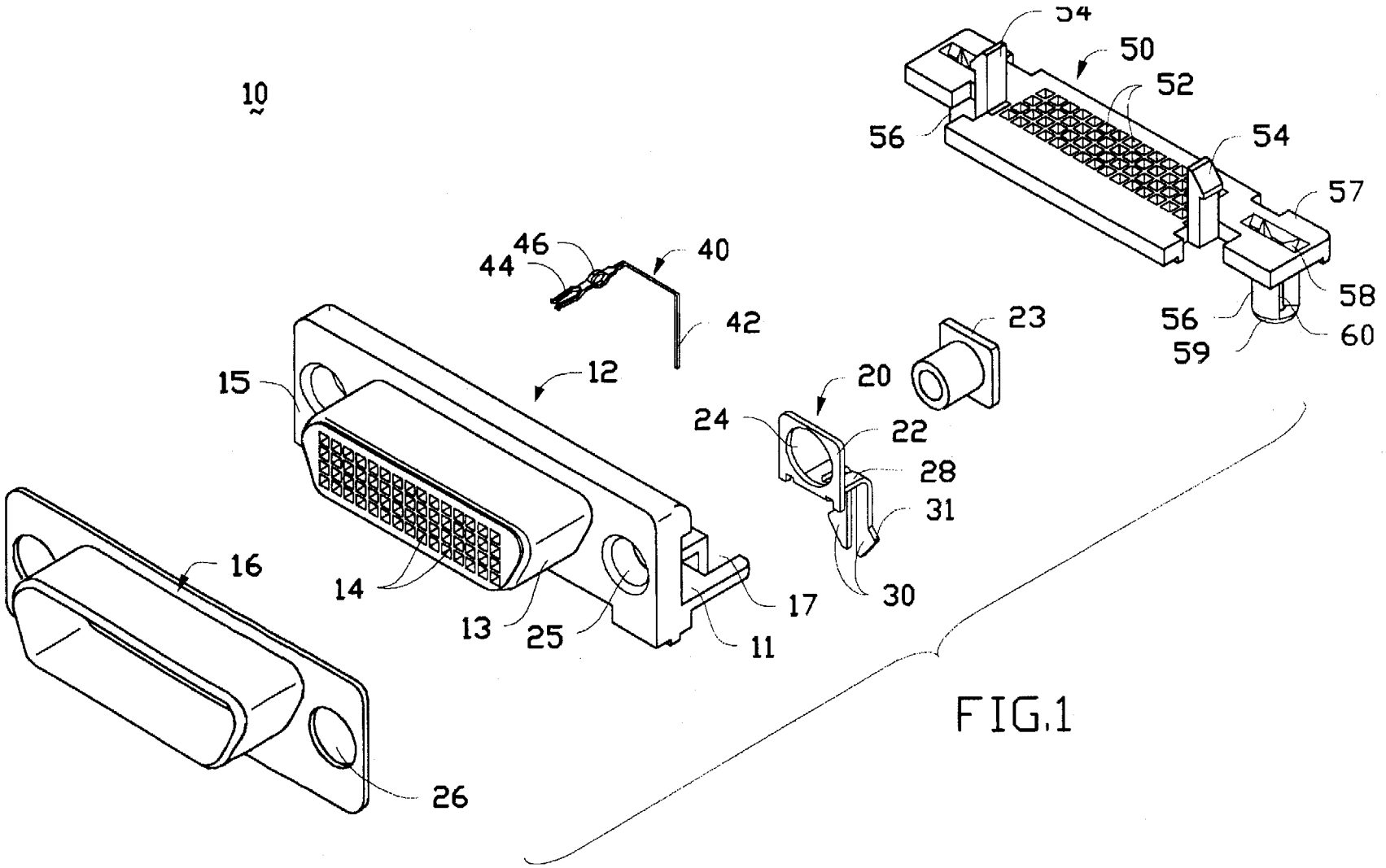
FIG. 1 is an exploded perspective view of a presently preferred embodiment of an electrical connector according to the invention, wherein only one contact is shown for illustration.

It will be noted here that for a better understanding, most of like components are designated by like reference numerals throughout the various figures in the embodiments. Attention is now directed to FIG. 1, wherein an electrical connector 10 includes an insulative housing 12 having an raised portion 13 for mating a complementary connector (not shown). A plurality of passageways 14 extend through the housing 12 in a front-to-end direction for receiving a corresponding number of contacts 40 therein. A shell 16 including a compliance configuration with the housing 12, is attached to the front surface 15 and the raised portion 13 of the housing 12.

A boardlock 20 includes a vertical section 22 which can be fixed to the housing 12 through a rivets" 23 extending through the hole 24 in the vertical section 22, the hole 25 in the housing 12 and the hole 26 in the shell 16. The boardlock 20 further includes a horizontal section 28 extending rearward from the bottom edge of the vertical section 22 and adapted to be seated on the horizontal plate 11 of the housing 12, and a pair of legs 30 downward extending from the rear edge of the horizontal section 28 which can extend through an opening 17 of the horizontal plate 11 of the housing 12 into a corresponding hole 102 in a PC board 100 (FIG. 6(A)–6(C) on which the connector 10 is mounted.

Figure 3:
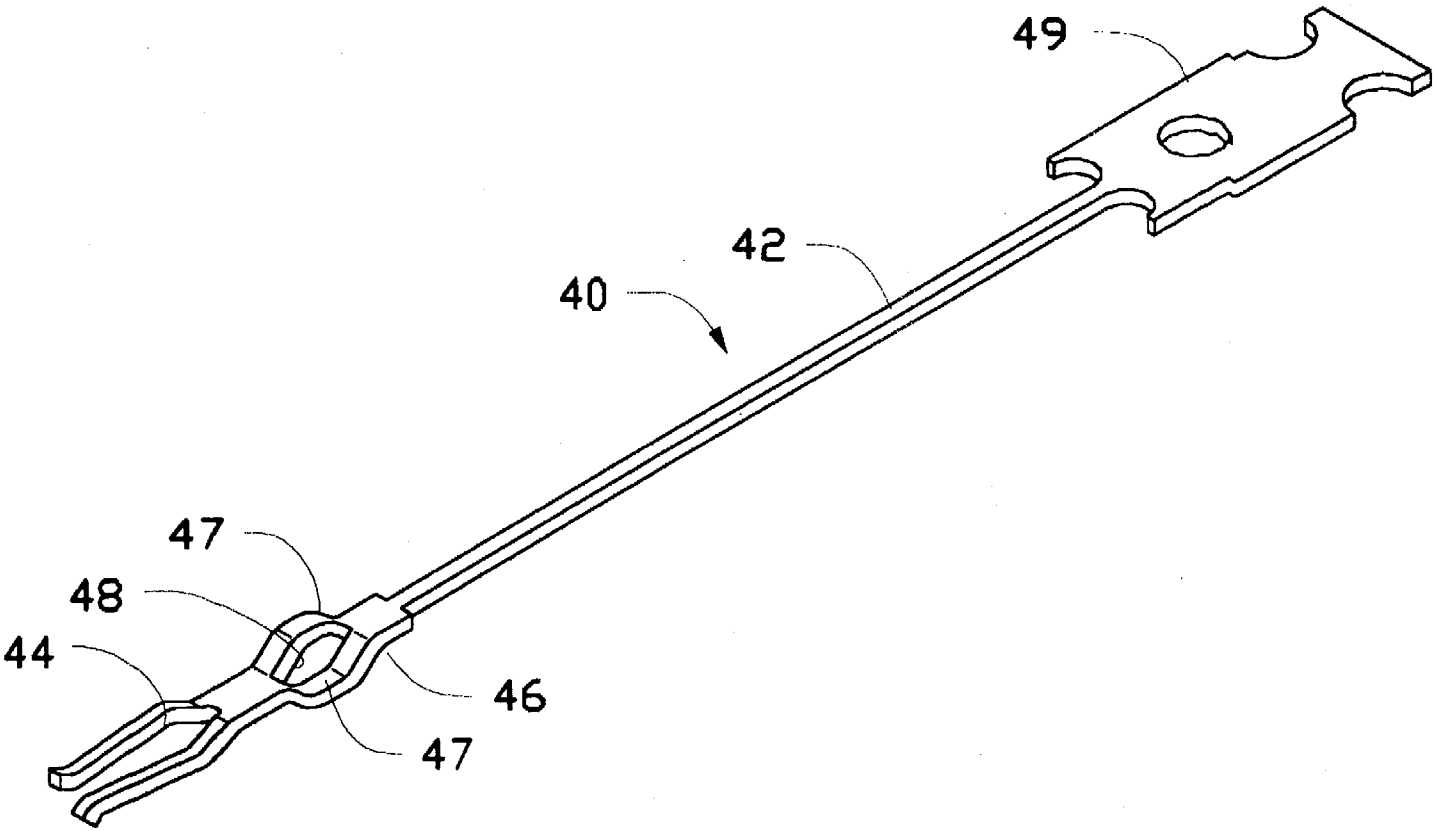
FIG. 3 is a perspective of the contact for use within the housing of the connector of FIG. 1.
Figure 4:
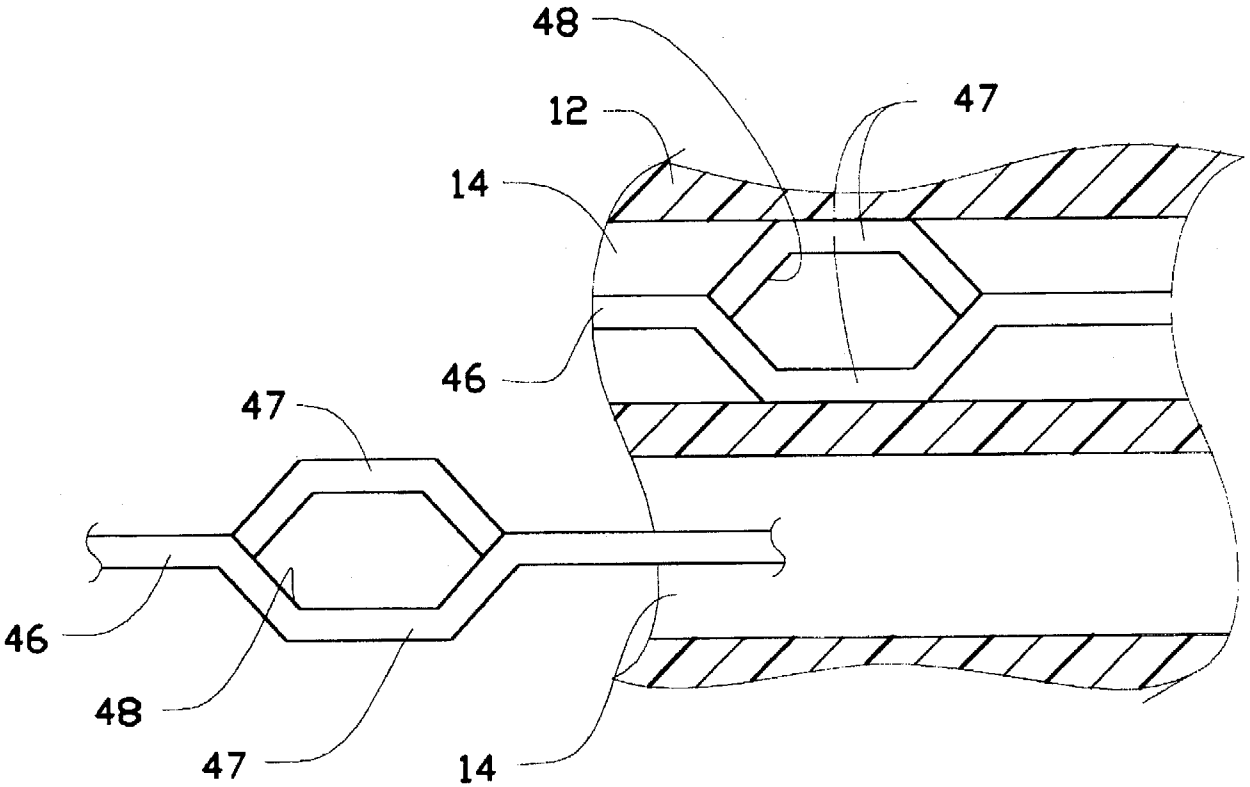
FIG. 4 is a fragmentary cross-sectional view of the connector of FIG. 1 to show the retention section of the contact before and after insertion into the passageway.

It should be noted that the contact 40 as shown in FIG. 3, is in a shape before being cut-off from the carrier 49 and bent. Referring to both FIGS. 1 and 3, each contact 40 includes a tail section 42 which generally extends downward for solderable insertion into a corresponding hole in the PC board 100. A fork type mating section 44 is formed in another end of the contact 40 for mating with another contact of a complementary connector (not shown), and a retention section 46 is positioned between the tail section 42 and the mating section 44 wherein the retention section 46 includes a pair of compliance expansions 47 having an opening 48 therebetween for provision of elasticity of such pair of expansions 47. Referring to FIG. 4, because the original distance between this pair of expansions 47 is substantially larger than the dimension of the passageway 14, such pair of expansions 47 may provide normal force against the internal wall of the passageway 14 of the housing 12, thus retaining the contact 40 in position with regard to the housing 12.

Figure 5:
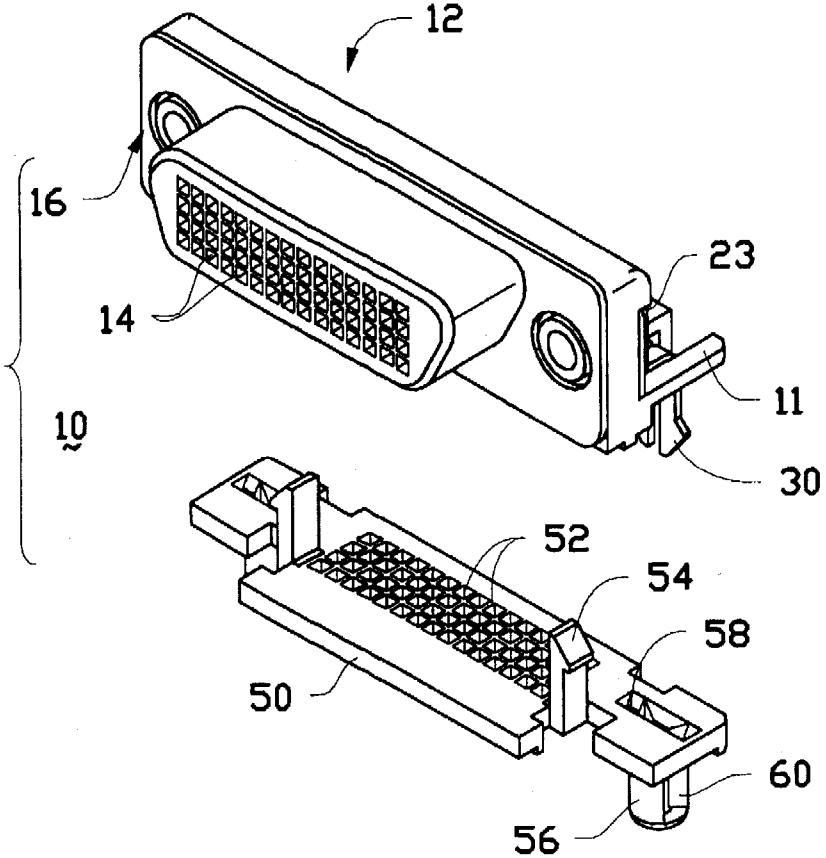
FIG. 5 is a perspective view of an assembled connector of FIG. 1 with the auxiliary alignment plate detached therefrom to show the plate is ready to be attached to the housing of the connector for aligning both the contact tails and the boardlocks of the connector.
Figure 6:
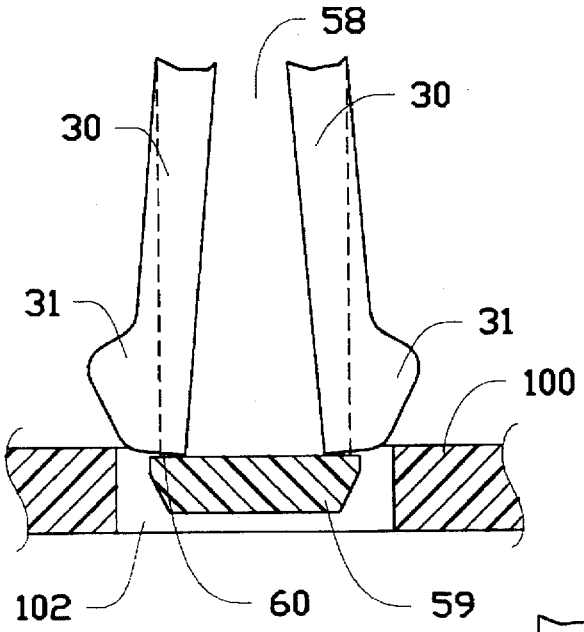
FIG. 6(A)–6(C) is partial cross-sectional views of the PC board on which the connector of FIG. 1 is mounted and the corresponding boardlock of connector of FIG. 1 to show how the boardlock in the corresponding post is inserted into and retained within the corresponding hole in the PC board.
Figure 6:
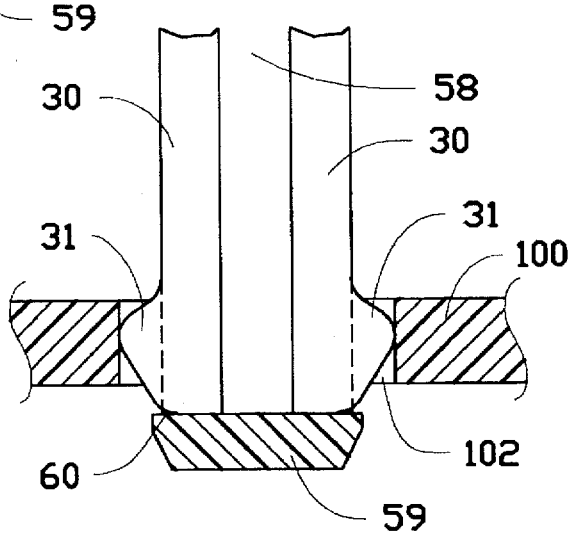
Figure 6:
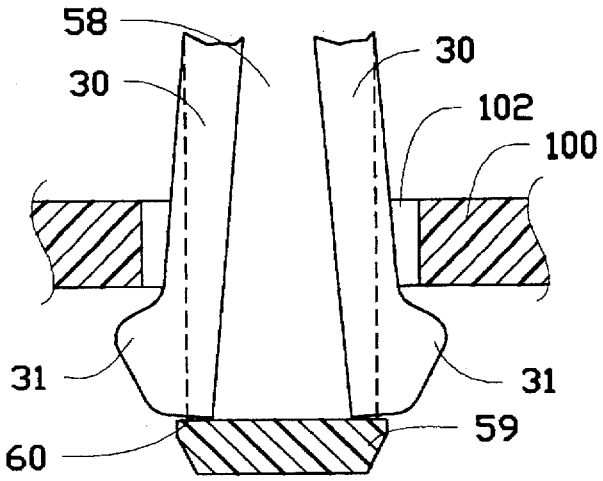

Referring to FIGS. 1, 5 and 6, the connector further includes an auxiliary alignment plate 50 defining a plurality of holes 52 extending therethrough in a vertical direction for aligning the corresponding tail sections 42 of the contact 40 when the connector 10 is completely assembled, so that the contact tail sections 42 may be easily and correctly inserted into the corresponding holes in the PC board 100.

Figure 2:
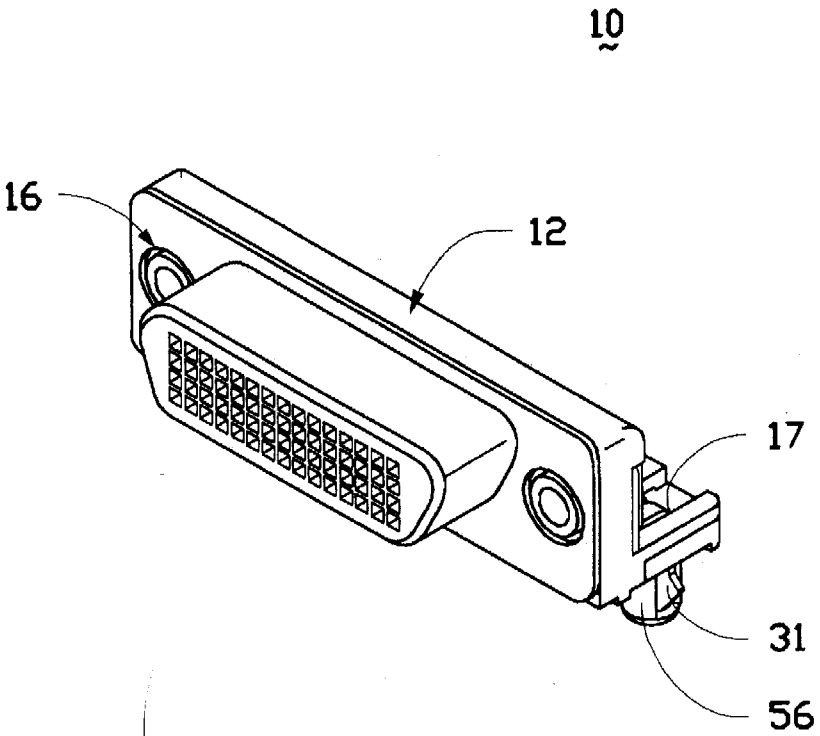
FIG. 2 is a perspective view of an assembled electrical connector of FIG. 1.

The plate 50 further includes a pair of latches 54 upward extending therefrom for locking the plate 50 to the housing 12. Moreover, a pair of posts 56 extend downward adjacent two opposite ends of the plate 50 wherein each post 56 includes a vertical groove 58 extending from the top surface 57 of the plate 50 and terminating approximate the bottom end 59 of the post 56. This groove 58 substantially extends through such post 56 in the diametrical direction to form a pair of opposite slits 60 on two sides of the post 56, so that when the plate 50 is assembled to the housing 12, the pair of legs 30 of the boardlock 20 may be received within the groove 58 in the post 56 and the locking sections 31 of the legs 30 may extend laterally from the slits 60 into the exterior as shown in FIG. 2.

When the connector 10 is mounted onto the PC board 100, the post 56 of the housing 12 and the legs 30 of the boardbock 20 therein may both be inserted into the hole 102 in the board 100 in serial steps as shown in FIGS. 6(A)–6(C).

The invention provides a device for both aligning the contact tails and the boardlock legs. It can be also noted that in the boardlock 20, the legs 30 are far from the vertical section 22 where the boardlock 20 is fixed to the housing 12, so, as experienced, sometimes the legs 30 may be tilted with regard to the hole 102 in the board 100. This is the reason why the alignment of the legs 30, through the post 56, is necessary. From another viewpoint, in this embodiment, even though the legs 30 are restrained within the slits 60 and/or groove 58, the legs 30 still keep the desired sufficient resiliency for easy insertion into and proper adjustment within the hole 102 of the board 100. This is because the legs 30 themselves are not directly fixed to the housing 12, and instead the true fixation of the boardlock 20 is still arranged to be in the vertical section 22. Therefore, the boardlock 20 of the invention maintains the desired resiliency for easy insertion and cooperation with the PC board 100, but without the tilting problem due to such resiliency.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical connector for mounting to a PC board, comprising:

an insulative housing defining a plurality of passageways for receiving a corresponding number of contacts therein;

each of said contacts including a retention section, a mating section and a tail section which extends downward toward said PC board;

at least a boardlock including retention leg means disposed at one end of the housing; and an auxiliary alignment device including a plate having a plurality of holes extending therethrough in a vertical direction for allowing the corresponding tail sections of the contacts to extend therethrough, and at least a post extending downward from one end of said plate for receiving said leg means of the boardlock; wherein said plate includes at least a latch extending upward whereby the latch and the post extend in two opposite directions, and the auxiliary alignment device is attached to the housing from the bottom in the vertical direction; and wherein said post includes a groove vertically extending downward from a top surface of the plate and terminating adjacent to a bottom end of the post, and wherein the leg means of the boardlock is received within said groove.

2. The Connector as described in claim 1, wherein said groove forms slits on two sides of the post in a diametrical direction of a cross-section of said post.

3. The connector as described in claim 1, wherein said boardlock further includes a vertical section and a horizontal section, and wherein the boardlock is fixed to the housing through said vertical section.

4. The connector as described in claim 1, wherein the retention section of each of the contact includes a pair of expansions a distance therebetween being larger than a cross-sectional dimension of the passageway before such contact is inserted into the passageway so as to retain the contact within the corresponding passageway in an interference fit.

5. An alignment device for use with a connector having contact tails and at least on boardlock thereof for mounting on a PC board, comprising:

a plate defining a plurality of holes extending therethrough in a vertical direction for aligning the contact tails of the connector; and at least a post downward extending at one end of the plate, said post including a groove extending vertically and forming at least a slit in a diametrical direction of a cross-section of the post for aligning leg means of the boardlock; wherein at least a latch extends upward from the plate for locking the alignment device to the connector whereby the latch and the post extend in two opposite directions, and the auxiliary alignment device is attached to the housing from the bottom in the vertical direction.

* * * * *